United States Patent [19]

Sargent et al.

[11] Patent Number: 4,769,860

[45] Date of Patent: Sep. 13, 1988

[54] PORTABLE TOILET HOLDING TANK SPOUT

[75] Inventors: Charles L. Sargent; John M. Antos, both of Ann Arbor; John A. Hoffman, Brighton; John T. Cameron, Dearborn Heights, all of Mich.

[73] Assignee: Thetford Corporation, Ann Arbor, Mich.

[21] Appl. No.: 820,758

[22] Filed: Jan. 17, 1986

Related U.S. Application Data

[63] Continuation of Ser. No. 710,528, Mar. 12, 1985, which is a continuation of Ser. No. 578,326, Feb. 13, 1984, abandoned, which is a continuation of Ser. No. 383,410, Jun. 1, 1982, abandoned.

[51] Int. Cl.[4] ..... E03D 1/00

[52] U.S. Cl. ..... 4/321; 4/323; 4/661; 4/460; 220/85 SP; 222/566; 222/567; 222/568

[58] Field of Search ..... 4/449, 455, 460, 471, 4/321-323; 137/269, 315, 587; 222/567, 566, 533, 570, 478; 288/401, 376, 360, DIG. 15; 220/85 SP, 296

[56] References Cited

U.S. PATENT DOCUMENTS

| | | | |
|---|---|---|---|
| 858,900 | 7/1907 | McNutt | 137/587 |
| 4,114,203 | 9/1978 | Carolan | 4/323 |
| 4,125,207 | 11/1978 | Ernst et al. | 222/533 |
| 4,215,445 | 8/1980 | Antos et al. | 4/323 |
| 4,570,273 | 2/1986 | Antos et al. | 4/321 |

*Primary Examiner*—Henry K. Artis

*Attorney, Agent, or Firm*—Harness, Dickey & Pierce

[57] ABSTRACT

A portable toilet comprises a spout via which accumulated waste contents are dumped at a suitable sanitary disposal station. The disclosed embodiment of portable toilet comprises separably mounted seat and holding tank sections which cooperatively define a storage housing for the spout when it is not in use. For dumping the two sections are separated. The spout is rotatably mounted in an aperture in the top wall of the holding tank and is swung from its stored position and a cap at the end of the spout is unscrewed. A vent valve is also provided in the top wall of the holding tank and it is manually operated by the person dumping the holding tank so as to vent the head space during dumping.

10 Claims, 4 Drawing Sheets

PORTABLE TOILET HOLDING TANK SPOUT

This application is a continuation of Ser. No. 710,528 filed Mar. 12, 1985, which is a continuation of Ser. No. 578,326 filed Feb. 13, 1984, now abandoned, which was a continuation of Ser. No. 383,410 filed June 1, 1982, now abandoned.

BACKGROUND AND SUMMARY OF THE INVENTION

This invention relates to portable toilets and is particularly concerned with a new and improved arrangement for emptying the contents of the holding tank of a portable toilet.

A number of commonly assigned patents disclose portable toilets of the type which comprise a holding tank section and a seat section separably mounted on the holding tank section. The seat section comprises a bowl with a bottom outlet which registers with an opening in the top wall of the holding tank. When the two sections are mounted together the bowl outlet is in sealed relationship with the opening in the top wall of the holding tank. A valve in the holding tank is disposed at the opening and when the valve is operated the contents of the bowl drop into the holding tank. The accumulated contents of the holding tank are dumped from time to time at suitable sanitary disposal stations.

One usual practice has been to provide a threaded boss circumscribing an outlet opening and a threaded cap threaded onto the boss to close the opening. When the contents are to be dumped, the cap is unscrewed and the waste materials poured out.

The present invention is directed to a new and improved arrangement for dumping the contents of the holding tank, and one of its advantages is that the dumping procedure is more convenient and can be accomplished with less concern for back-splashing of the waste discharge.

Further advantages accrue in the disclosed preferred embodiment of the invention in which the improved arrangement comprises a rotatably mounted discharge spout on the exterior of the holding tank one end of which fits into an aperture in the top wall of the holding tank and the other end of which is closed by a removable cap. The aperture is located at one corner of the top wall of the holding tank and the end of the discharge spout which fits into the aperture comprises a key. A mating key is provided on the aperture, and the keys are constructed such that the spout can be inserted into and removed from the aperture only in one rotational position. The spout may be rotated about the axis of the aperture away from said one position over a range of positions in which the inter-engaged keys prevent separation of the spout from the holding tank. The holding tank comprises side walls which meet at the corner of the top wall containing the aperture, these side walls being generally at a right angle to each other. The aperture key is arranged such that the spout can be inserted into and removed from it with the spout overlying the top wall and disposed generally parallel to one of these two side walls. The spout may be rotated from this installation and removal position approximately three-quarters of a full circle so as to overlie the top wall in a position which is generally parallel with the other side wall. This latter position constitutes a storage position for the spout. The preferred embodiment is disclosed as a portable toilet of the type comprising a seat section which is separably mounted on the holding tank section. The two sections are constructed such that they cooperatively define a cavity forming a housing for the spout when the spout is in the storage position. In this way the spout is essentially concealed from view when the two sections are mounted together.

In order to dump the contents of the holding tank the two sections are separated and the spout is rotated away from its storage position to a position pointing away from the holding tank. The cap is removed, and the tank is tipped so that the waste contents are discharged from the far end of the spout.

In order to promote a smooth flowing discharge which is substantially immune from objectionable characteristics such as belching, a vent valve is provided on the wall of the holding tank for venting the interior held space during dumping. The disclosed embodiment of vent valve comprises a normally closed spring biased element with an actuator positioned adjacent to a gripping portion of the toilet so that when the toilet is gripped for dumping it is particularly convenient for the person to operate the vent valve actuator concurrent with the grasping and tipping of the holding tank. After the dumping procedure has been completed, the cap is screwed onto the spout, and the spout is returned to its storage position.

The foregoing features, advantages and benefits of the invention along with additional ones, will be seen in the ensuing description and claims which should be considered in conjunction with the accompanying drawings.

The drawings disclose a preferred embodiment of the invention according to the best mode contemplated at the present time in carrying out the invention.

DESCRIPTION OF THE PREFERRED EMBODIMENT

Figure 1:
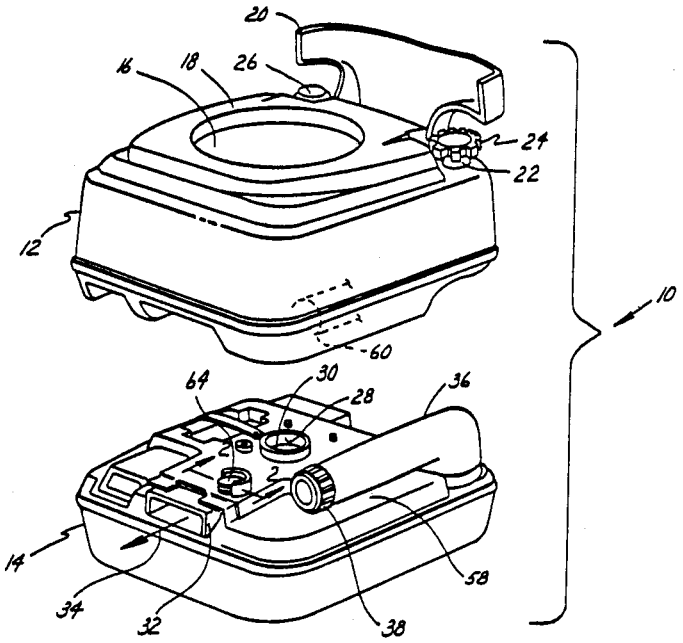
FIG. 1 is a perspective view having a portion broken away of an embodiment of portable toilet comprising principles of the present invention.

FIG. 1 illustrates a portable toilet 10 embodying principles of the invention. The toilet comprises a seat section 12 which separably mounts on a holding tank section 14 in a conventional manner. FIG. 1 shows the two sections separated. The seat section 12 comprises a bowl 16 and an overlying seat 18 and cover 20 which are hingedly mounted on this section. A flush water storage tank or chamber (not viewable) is provided within the interior of seat section 12 and it may be filled with fresh water via a fill port 22 which is covered by a removable cap 24. A pumping mechanism 26 is also provided for pumping fresh water from the water storage chamber into bowl 16 for use. The bowl comprises a bottom outlet (not viewable) which registers with an inlet opening 28 in the top wall of holding tank 14. Opening 28 is closed by a slide valve 30 mounted within the interior of the holding tank. The slide valve is operated by a handle 32 which is disposed at the front wall of the holding tank section. In order to open valve 30 the operating handle is moved in the direction of arrow 34. As valve 30 slides open, the contents of bowl 16 drop into the holding tank. Thereafter the operating handle is moved in the opposite direction to close valve 30. In this way holding tank 14 accumulates waste contents for later disposal at a suitable sanitary disposal station. Because of the separable mounting of the two sections 12 and 14 the holding tank section 14 can be removed for dumping.

Dumping of the holding tank contents is accomplished through a discharge spout 36 on holding tank 14. Spout 36 is a hollow tubular element having a right angle bend. One end is operatively engaged with the holding tank while the opposite end is closed by a removable cap 38. Details of the spout construction can be best seen in FIGS. 4 through 8.

The end of the spout on which cap 38 is disposed is provided with an integrally formed screw thread 40. Cap 38 has a similar thread which allows the cap to be screwed onto the end of the spout to close it. When the contents are to be dumped the cap is unscrewed and removed. Preferably a circular sealing gasket 42 is lodged within cap 38 so as to provide a seal between the end wall of the cap and the edge 44 of the spout at the discharge opening when the cap is fully tightened on the spout.

The opposite end of the spout is of a generally circular shape but it comprises a multi-lobed key 46. Specifically the key 46 comprises six circumferentially spaced lobes which are identified by the reference numerals 46*a*, 46*b*, 46*c*, 46*d*, 46*e*, and 46*f*. It also comprises a circular groove 48 adjacent to key 46 for an O-ring gasket seal 50.

The holding tank wall is provided with a circular walled aperture 52 within which the keyed end of spout 36 is disposed. A complementary mating key 54 (shown in phantom in FIG. 8) is disposed on the wall of aperture 52. Key 54 allows the spout to be fully inserted into aperture 52 only when the two keys are in circumferential registry. The arrangement of key 54 in relation to the holding tank is such that circumferential registry of the two keys 46, 54 occurs with the spout in the position shown in FIG. 4.

It will be observed that the holding tank has a generally rectangular shape and that the aperture 52 is provided in the top wall at one corner. Thus the installation position of the spout is such that the spout overlies the top wall and is generally parallel to the far shorter side wall as viewed in FIG. 4. The construction of aperture 52 and key 54 is such that when the spout is fully inserted into the aperture the key 46 is disposed just beyond the key 54. At this point the O-ring gasket 50 is engaged with the wall of the aperture so that a leakproof joint is thereby provided. Next the spout is rotated in the direction of arrows 56. As key 46 leaves its circumferential registry with key 54, certain portions of the individual lobes of the keys are always in interlocking engagement which prevents the spout from coming out of the aperture. The dimensional relationships are such that this is true over all positions of a full circular revolution of the spout about the aperture. However, the illustrated construction is such that the operative range is less. When the spout has been rotated three quarters of a revolution from its insertion position, it occupies another position which once again overlies the top wall but is now parallel to the nearer longer side of the holding tank as viewed in FIG. 4. This is also the position which is illustrated in FIG. 1, and it constitutes a storage position for the spout.

Figure 4:
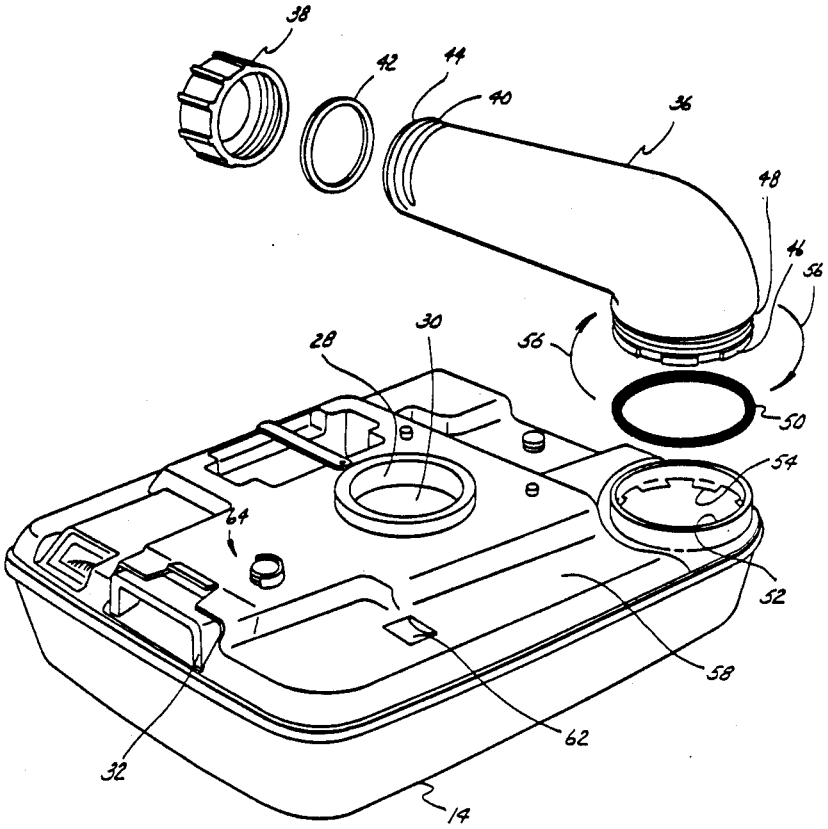
FIG. 4 is a partly exploded perspective view, on an enlarged scale, of one portion of FIG. 1.
Figure 5:
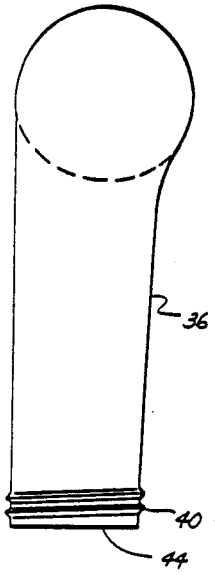
FIG. 5 is a top plan view of one element shown by itself.
Figure 6:
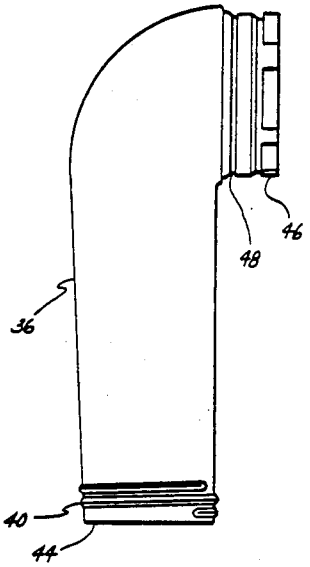
FIG. 6 is a right side view of FIG. 5.
Figure 7:
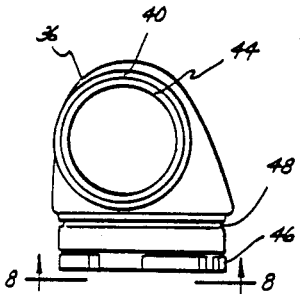
FIG. 7 is a front view of FIG. 5.
Figure 8:
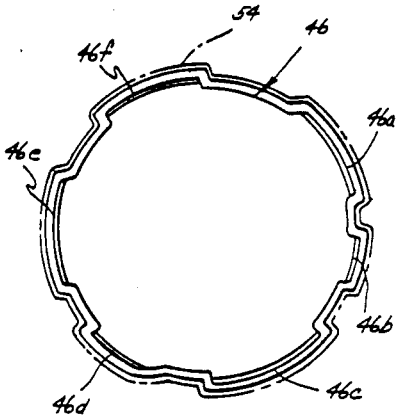
FIG. 8 is a view taken in the direction of arrows 8—8 in FIG. 7 and enlarged.

In the storage position of the spout the two sections 12 and 14 may be mounted together. The two sections cooperatively define at their confronting surfaces a cavity which forms a storage housing for the spout when the spout is in the stored position. The illustrated construction is such that one portion of the storage housing may be considered as comprising the area identified by the reference numeral 58 in holding tank section 14 while the remainder is defined in section 12 by the portion designated by the reference numeral 60. The cavity forming the housing is integrally molded with the molded plastic sections 12 and 14. As can be seen in FIG. 4 a depression 62 is fashioned in the top wall of the holding tank. When spout 36, with cap 38 attached, is rotated to the storage position the lower edge portion of the cap lodges in the depression 62 and in this way the depression defines a locator for the storage position of the spout.

Figure 9:
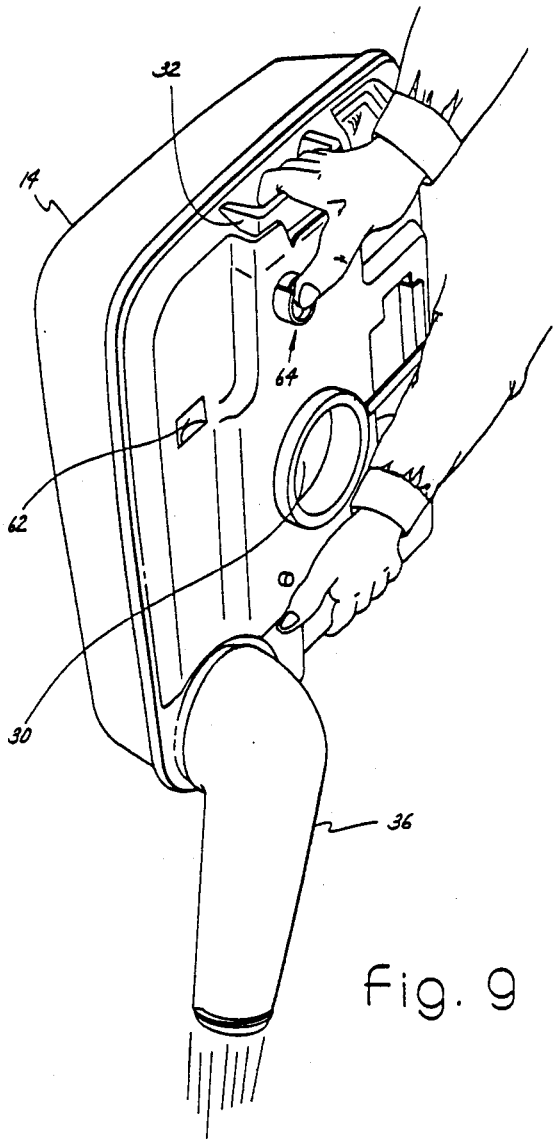
FIG. 9 is a perspective view illustrating the dumping procedure.

For dumping, seat section 12 is separated and removed from holding tank section 14 and the holding section is taken to an appropriate sanitary disposal station. The spout is swung away from its storage position and cap 38 is removed. The spout will typically be pointed away from the holding tank and will not normally come close to the installation-removal position. In other words rotation to the installation-removal position would be contrary to the objective of dumping the tank, and therefore accidental separation of the spout from the holding tank is essentially impossible. Moreover, when the spout is in other than its storage position, the two sections 12, 14 cannot be mounted together. FIG. 9 illustrates a typical dumping procedure and in that procedure the spout has been rotated from its storage position only about 180°. This would probably be the most amount of rotation, and other typical positions would be somewhat less.

In order to promote a reasonably smooth discharge flow of the waste contents through the spout it has been found beneficial to include a venting means for directly venting the head space of the holding tank to atmosphere during dumping. Venting lessens greatly the tendency for belching or burping of discharging waste materials.

The disclosed embodiment comprises a vent valve 64 disposed on the top wall of the holding tank somewhat opposite aperture 52. Details of the vent valve can be seen in FIGS. 2 and 3. The top wall of the holding tank is fashioned with an integral circular boss 66 the lower portion of which projects into the interior of the holding tank. The boss has a top wall 68 with a recess 69 formed centrally therein. Recess 69, at the bottom, comprises a circular hole 70 concentric with the boss. Four arcuate vent openings 72 are in wall 68 extending around recess 69 on a common circle. Openings 72 provide, via the interior bore of boss 66, venting of the tank interior to atmosphere. A valving element 74 comprises a bifurcated shank 76 which fits closely within hole 70. A circular actuator button 78 is at the top of shank 76 and a helical spring 80 is disposed around shank 76 and between the bottom wall of recess 69 and actuator button 78. The spring 80 biases the valving element 74 in the upward direction so as to urge a suitable closure portion 82 against the lower circular edge of boss 66 so as to close the interior bore of the boss and hence the vent openings 72. The illustrated construction for the closure portion comprises a rigid circular portion 84 which is affixed to the lower end of shank 76 within the holding tank and which supports an annular gasket 86 which seals against the lower circular edge of boss 66 when the valve is closed.

Figure 2:
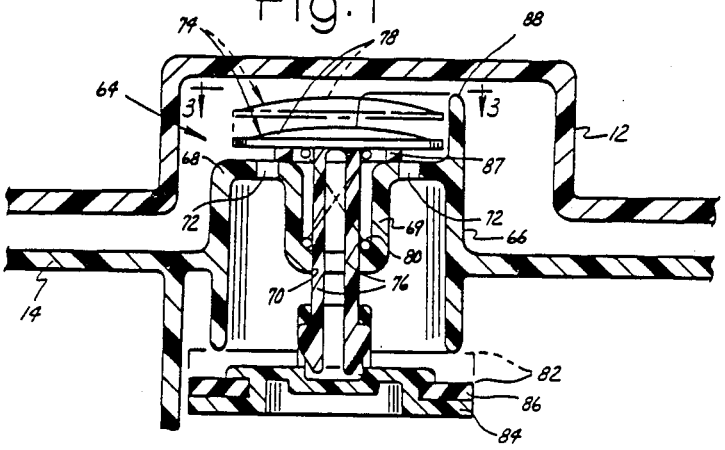
FIG. 2 is an enlarged vertical sectional view taken substantially in the direction of arrows 2—2 in FIG. 1.
Figure 3:
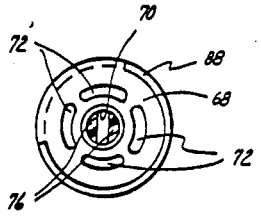
FIG. 3 is a horizontal sectional view, on a reduced scale, taken in the direction of arrows 3—3 in FIG. 2.

The broken line position shown in FIG. 2 thus represents the closed position to which the valving element which is normally spring biased. In this position the closure portion prevents waste materials and vapors from passing through the vent openings 72. The solid line position illustrates the actuated position which isused during dumping to vent the interior head space of the holding tank. It should be observed that a stop 87 is provided on button 78 for limiting downward displacement so that the button does not close off the vent openings when the valve is depressed. This, actuation of the valve always allows air to pass through openings 72 into the holding tank to prevent the creation of the partial vacuums which might give rise to belching and burping during dumping.

It will be further observed that the location of the vent valve 64 is adjacent to the operating handle 32. As can be appreciated from consideration of FIG. 9 the operating handle also forms a portion of a grip which may be grasped by a person dumping the holding tank. The configuration is such that the person's fingers fit conveniently onto the handle with the actuator button being poised to be pushed by his thumb to the venting position. An upstanding lip 88 extends partially around (slightly more than a semi-circle) the outside of the top wall 68 of boss 66. The upper edge of lip 88 is above button 78 when the valve is closed and it forms a protector against inadvertent actuation of the valve. It also assists in preventing thumb slippage while the button is being depressed. Thus function and convenience are greatly promoted by the arrangement.

Because the vent is located generally opposite the discharge spout it will inherently be exposed to the head space of the tank during dumping, the tank being designed to leave a head space when its liquid waste content is completely full. Accordingly, liquid waste will not accidentally pass through the openings 72.

The particular constructional details of the seat and holding tank sections, the vent valve and the spout may be accomplished with conventional materials and techniques. In accordance with the typical manufacturing procedures the tanks sections are fabricated from two injection molded halves having mating perimeters. The mating perimeters are mated and sealed to form the enclosure. The spout may also advantageously be fabricated from plastic and it may be manufactured by any suitable plastic forming technique such as injection molding or blow molding. The vent valve components are also plastic, with the exception of spring 80, and the element 86 being a suitable elastomeric material. The assembly of the vent valve to the holding tank may be accomplished by fabricating the valving element as separate pieces which are assembled together once they are in the correct position. The illustrated construction of bifurcated shank 76 includes catches at the distal end and the element 84 includes slots. The attachment involves the end of shank 76 snapping onto element 84 at the inside the top wall of the tank so that the catches lodge in the slots. Other alternative attachment procedures could also be used.

The invention promotes conveniences in dumping because the point at which the waste contents exit the spout is more remotely located from the person than would be the case with prior types. The use of the venting valve promotes smoother discharge flow and hence there is a significant reduction in an individual's concern about waste contents splashing back. The construction is also advantageous in that the spout is stored interiorly of the unit and does not protrude, except at dumping. The unit retains overall compactness yet possesses improved function.

While a preferred embodiment has been disclosed, it will be appreciated that other embodiments are contemplated within the scope of the following claims.

What is claimed is:

1. In a portable toilet comprising a generally rectangular holding tank section having a pair of ends and a top extending between said ends, said toilet further including a seat section separably mounted on the holding tank section, said seat section including a bowl and said holding tank section including a valve which is operable to allow liquid matter including solid and semi-solid waste products deposited on the bowl to be transferred into the holding tank, the improvement which comprises a discharge spout via which the contents of the holding tank may be emptied, said seat and holding tank sections cooperatively defining between their confronting surfaces a cavity with said spout being disposed for storage in the cavity and being positionable from its storage position to a discharge position on the holding tank section for emptying the contents of the holding tank after the seat section has been removed from the holding tank, said spout in said discharge position being rotatably mounted on said top surface adjacent one end of said holding tank to enable an individual emptying said holding tank to manually hold the other end of said holding tank and direct said spout away from said holding tank so that the discharge end thereof is spaced from said holding tank, said discharge spout being structured to enable continuous flow therethrough of said solid and semi-solid waste in said holding tank, and said discharge spout pointing away from said holding tank to enable said spout to extend downwardly into a restricted space in a flush toilet into which said holding tank is to be emptied so that the discharge end of the spout can be located adjacent the bottom of the bowl in said flush toilet so that when liquid, solid and semi-solid waste issue from said spout the resulting splashing of waste will be minimized.

2. The improvement set forth in claim 1 including normally closed vent valve means operable during emptying of the holding tank for venting the head space of the holding tank.

3. The improvement set forth in claim 1 wherein the holding tank section comprises an aperture with one end of the spout being disposed in said aperture and with the spout being rotatably mounted at the aperture for positioning between the storage and discharge positions.

4. The improvement set forth in claim 2 in which said confronting surface of said holding tank section is the top wall thereof and wherein said normally closed vent valve means and said discharge spout mount on said holding tank top wall.

5. The improvement set forth in claim 4 in which said holding tank top wall has a generally four sided shape, said holding tank being provided with an aperture at one of the four corners of said top wall, said spout having one end disposed in said aperture and being rotatably mounted on said aperture for positioning between the storage and discharge positions, said normally closed vent valve means being disposed adjacent a side of said holding tank top wall opposite one of said sides of said top wall forming the corner at which said aperture is located.

6. In a portable toilet holding tank which receives liquid matter including solid and semi-solid waste products and has side walls and a top wall, the improvement which comprises a separate discharge spout on the exterior of the holding tank which removably fits an aperture in the top wall of the holding tank through which waste contents of the holding tank can be poured out, said aperture being located adjacent one of said side walls and said spout being located on said top wall in a discharge position in which the discharge spout projects a significant distance beyond said one side wall, said spout in said discharge position enabling an individual emptying said holding tank to manually hold said holding tank and direct said spout away from said holding tank, so that the discharge end thereof is spaced from said holding tank, said discharge spout being a hollow tubular element structured to enable continuous flow therethrough of said sold and semi-solid waste in said holding tank, and said discharge spout pointing away from said holding tank to enable said spout to extend downwardly into a restricted space in a flush toilet into which said holding tank is to be emptied so that the discharge end of said spout can be located adjacent the bottom of the bowl in said flush toilet so that when liquid, solid and semi-solid waste issues from said spout the resulting splashing of waste will be minimized.

7. The portable toilet according to claim 6, wherein said holding tank includes normally closed vent valve means also disposed in said top wall and operable during emptying of the holding tank via said discharge spout for venting the head space of the hodling tank, said normally closed vent valve means being disposed adjacent an end of said top wall of said holding tank section opposite said aperture.

8. The portable toilet according to claim 6, wherein the discharge spout is totally mounted in said aperture in the top wall of the holding tank for rotation over a range of positions such that at one extreme of its rotational positions the discharge spout fully overlies the top wall so as not to overhang the sidewall of the holding tank and at the other extreme of its rotational positions the discharge spout also fully overlies the top wall so as not to overhang the sidewall of the holding tank, said discharge spout being operable between said two extremes to said discharge position where the discharge spout projects beyond the holding tank sidewall.

9. The portable toilet according to claim 6, wherein the discharge spout is rotatably mounted in said aperture in the wall of the holding tank for rotation over a range of positions and is retained on the holding tank solely by means of a keyed connection.

10. The portable toilet according to claim 6 wherein the discharge spout is rotatably mounted in said aperture in the wall of the holding tank for rotation over a range of positions, said aperture being bounded by a circular flange comprising a smooth circular sealing surface and said spout having a smooth circular sealing surface, a seal disposed between said two sealing surfaces to seal the connection between the spout and tank over said range of positions, and said spout and tank being formed with respect integral portion via which the spout connects to the tank and which allow the spout to rotate while the effectiveness of the seal is maintained.

* * * * *